US008714176B2

(12) United States Patent
Kerr et al.

(10) Patent No.: US 8,714,176 B2
(45) Date of Patent: May 6, 2014

(54) PROTECTION SYSTEM AND METHOD

(75) Inventors: Gareth Ian Kerr, Stonehaven (GB); John Arthur Mair, Aberdeen (GB)

(73) Assignee: Subsea 7 Limited, Sutton (GB)

( * ) Notice: Subject to any disclaimer, the term of this patent is extended or adjusted under 35 U.S.C. 154(b) by 1010 days.

(21) Appl. No.: 12/450,932

(22) PCT Filed: Apr. 17, 2008

(86) PCT No.: PCT/GB2008/001351

§ 371 (c)(1),
(2), (4) Date: Apr. 30, 2010

(87) PCT Pub. No.: WO2008/129252

PCT Pub. Date: Oct. 30, 2008

(65) Prior Publication Data

US 2010/0206399 A1 Aug. 19, 2010

(30) Foreign Application Priority Data

Apr. 19, 2007 (GB) ..... 0707570.8

(51) Int. Cl.
*F16K 17/36* (2006.01)
*G05D 7/00* (2006.01)

(52) U.S. Cl.
USPC ..... 137/2; 137/81.2; 137/102

(58) Field of Classification Search
USPC ..... 137/81.2, 102, 596, 637.1, 637.3, 2; 251/251, 262, 263
See application file for complete search history.

(56) References Cited

U.S. PATENT DOCUMENTS

| | | | | | |
|---|---|---|---|---|---|
| 2,204,530 | A | * | 6/1940 | Eaton | 303/54 |
| 2,364,626 | A | * | 12/1944 | Emerson | 128/204.25 |
| 2,376,348 | A | * | 5/1945 | Fox | 128/204.25 |
| 3,913,621 | A | * | 10/1975 | Damratowski | 137/630.2 |
| 4,704,951 | A | * | 11/1987 | Pruchon | 454/58 |
| 4,711,263 | A | * | 12/1987 | Ottestad | 137/102 |
| 5,020,564 | A | * | 6/1991 | Thoman et al. | 137/102 |
| 5,094,260 | A | * | 3/1992 | Stuart et al. | 137/102 |
| 5,257,640 | A | * | 11/1993 | Delajoud | 137/14 |
| 5,542,446 | A | | 8/1996 | Rose | |
| 5,551,800 | A | | 9/1996 | Hobelsberger | |
| 5,816,283 | A | * | 10/1998 | Ostand | 137/209 |
| 2005/0075018 | A1 | | 4/2005 | Urabe | |

* cited by examiner

*Primary Examiner* — John Fox
*Assistant Examiner* — Kevin Murphy
(74) *Attorney, Agent, or Firm* — Levy & Grandinetti

(57) ABSTRACT

The invention provides a protection system for a fluid compartment of variable volume. The protection system comprises a detection means for detecting when the volume of the fluid compartment is outside a predetermined acceptable limit. The protection system also comprises a valve arrangement mountable on at least one port that is in selective fluid communication with the fluid compartment. The protection system further comprises an actuator, wherein the detection means is coupled to the valve arrangement via the actuator. When the detection means detects that the volume of the fluid compartment is outside the predetermined limit, the actuator causes the valve arrangement to change state and alters the volume of the fluid compartment. The protection system can be used with a compensator to protect a movable part of the compensator from damage.

22 Claims, 9 Drawing Sheets

326
355
357
382
380

390
392
326
355
357
382
380

355
357
380

326
352
354
393
390
395
352
384
392

380
382
354

PROTECTION SYSTEM AND METHOD

RELATED APPLICATION

This Application is the U.S. National Phase Application of PCT International Application No. PCT/GB2008/111351 filed Apr. 17, 2008.

FIELD OF THE INVENTION

The invention relates to a protection system for a fluid compartment and a method for protecting a fluid compartment of variable volume. The invention also provides a compensator.

DESCRIPTION OF THE RELATED ART

Equipment that is used subsea is typically exposed to a wide range of pressures; from surface pressure to high subsea pressures. In such a situation, it may be preferable to ensure that the internal pressure of the equipment is approximately balanced with the ambient pressure so that no significant pressure differential exists across the housing of the equipment. Eliminating large pressure differentials across the housing is advantageous, since the housing need only be designed for the mechanical loads associated with its operation. This avoids the need for the equipment housing to be constructed to withstand high pressures. A device such as this that is used to maintain a fluid within a housing close to the variable ambient pressure can be referred to as a "compensator".

Compensators are known to develop leaks or fail, with the result that they cannot continue to function efficiently and accurately. In order to account for this, there is a need to regularly inspect and assess the condition of compensators. Also if such a problem is not prevented, there is a potential that the compensator, or the equipment to which it is attached, will be permanently damaged.

BRIEF SUMMARY OF THE INVENTION

According to a first aspect of the invention there is provided a protection system for a fluid compartment of variable volume, the protection system comprising:

- a detection means for detecting when the volume of the fluid compartment is outside a predetermined acceptable limit;
- a valve arrangement mountable on at least one port that is in selective fluid communication with the fluid compartment; and
- an actuator, wherein the detection means is coupled to the valve arrangement via the actuator, such that when the detection means detects that the volume of the fluid compartment is outside the predetermined limit, the actuator causes the valve arrangement to change state and alters the volume of the fluid compartment.

According to the first aspect of the invention, there is also provided a method of protecting a fluid compartment of variable volume, the method comprising the steps of:

- mounting a valve arrangement on at least one port that is in selective fluid communication with the fluid compartment;
- coupling the valve arrangement to a detection means via an actuator;
- detecting when the volume of the fluid compartment is outside a predetermined acceptable limit; and

- actuating the valve arrangement to change state and alter the volume of the fluid compartment when the detection means detects that the volume of the fluid compartment is outside the predetermined limit.

Preferably, the actuator causes the valve arrangement to change state and alter the volume of the fluid compartment until the volume of the fluid compartment is within the predetermined limit.

The valve arrangement can be controllable by the actuator to maintain the volume of the fluid compartment between two predetermined limits. Thus, the volume of the fluid compartment can be maintained within a predetermined acceptable range.

The valve arrangement can comprise a vent valve, which is actuable to vent fluid from the fluid compartment. The valve arrangement can comprise an inlet valve to introduce fluid into the fluid compartment.

The valve arrangement mountable on at least one port can comprise at least one of the following types of valves: a ball valve; a poppet valve; and a solenoid valve. Other types of valve known in the art can be used such as gate valves.

The valve arrangement can comprise one valve mountable on the port. The valve can be controllable by the actuator to maintain the volume of the fluid compartment between two predetermined limits. The valve can be configured to act in both a vent position or an inlet position. The valve can be sequentially actuated into the inlet position and the vent position. The valve can be a three-way ¼ turn ball valve.

The valve arrangement can comprise two valves that are controllable to maintain the volume of the fluid compartment between two predetermined limits. One of the valves can be arranged to maintain the volume of the fluid chamber within an upper limit and the other valve can be actuable to maintain the volume of the fluid chamber above a lower limit.

The valve arrangement can comprise two valves each mountable on a respective port. One of the valves can be actuable to vent fluid from the fluid compartment and the other valve can be actuable to allow the port to function as a fluid inlet.

The at least one port of the fluid compartment can act as at least one of a fluid inlet and a fluid outlet. The port(s) can be in fluid communication with at least one reservoir. The reservoir(s) can act as a fluid supply when the port acts as an inlet or a collection chamber for fluid vented from the fluid compartment.

At least a part of the fluid compartment can be a moveable to alter the volume of fluid within the compartment. The volume of the fluid compartment can be changeable according to an external stimulus acting on a movable part of the fluid chamber. The external stimulus can be a pressure differential across the movable part.

The predetermined limits at which the valves are actuable can correspond to a damaging pressure differential between the interior of the fluid compartment and the ambient environment surrounding the movable part of the compartment.

The actuator can be arranged to cooperate with the valve arrangement to positively change the valve(s) from one state to another. This allows the valve(s) to be positively opened and shut.

The actuator can be arranged to cooperate with the valve arrangement to positively change the at least one valve into one state and the at least one valve can be biased into a return position. The at least one valve can be biased into the return position by means of a spring.

The at least one actuator can include a dwell period that allows valve(s) to remain in one state for a predetermined period of time prior to a further change in state of the valve(s).

This can account for reaction time between a change in state of a valve and the resultant change in the volume of the fluid compartment.

The detection means can comprise a mechanical or hydraulic mechanism linked to the movable part of the fluid compartment to directly translate movement of the movable part of the fluid compartment into corresponding movement of the actuator.

The actuator can comprise protrusions that cooperate with the valve to change the state of the or each valve. The protrusions can act to turn the valve(s) to change the state of the valve(s).

The actuator can comprise a cam plate that is cooperable with the valve(s). The cam plate can be directly movable by the mechanical coupling to link movement of the cam plate with the movable part of the fluid compartment. Alternatively, the cam plate can be directly movable by the hydraulic coupling to link movement of the cam plate with the movable part of the fluid compartment.

The or each valve can be provided with a cam follower. The cam plate can have a slot for receiving the or each cam follower, which plate is moveable in concert with the moveable part of the fluid compartment. The slot can be shaped or "kinked" and the cam follower on each valve can be constrained to move in the slot to turn the cam and thus change the state of the valve when the cam follower reaches the appropriate part of the slot on the cam plate.

Alternatively, the detection means can comprise a remote detector such as a reed switch, proximity sensor and the like operable by membrane movement.

The protection system can also comprise at least one of: a movable part position alarm; and a compensator pressure alarm. These can serve to alert operators to potential failures, should the primary i.e. protection system fail.

The protection, system can form part of a compensator to protect a pressure transfer barrier of the compensator from an excessive pressure differential.

The protection system is suitable for use in any device having a fluid compartment with variable volume that requires to be maintained within at least one given allowable limit.

According to a second aspect of the invention, there is provided a compensator comprising:

- a compartment arranged to contain fluid wherein at least one of the walls defining the compartment is a moveable member, which moveable member is moveable to alter the volume of the compartment; and
- a protection system arranged to substantially maintain the volume of the compartment within at least one predetermined limit.

The compensator can comprise the protection system previously described.

The movable member of the compensator can be provided with a bias towards the interior of the compartment.

In practice, and where appropriate, the internal pressure can be maintained at a slightly higher level than the external ambient pressure to ensure that any leakage of fluid is outwards, thus avoiding contamination of the internal fluid through ingress from the surrounding medium.

The change in state of the valve arrangement can be triggered by a change in volume of the fluid compartment as the flexible element moves in response to the effects of other physical parameters, such as pressure and temperature that are acting upon it and changing the conditions of equilibrium.

BRIEF DESCRIPTION OF THE SEVERAL VIEWS OF THE DRAWINGS

Embodiments of the present invention will now be described with reference to and as shown in the following drawings in which.

DETAILED DESCRIPTION OF THE INVENTION

Figure 1:
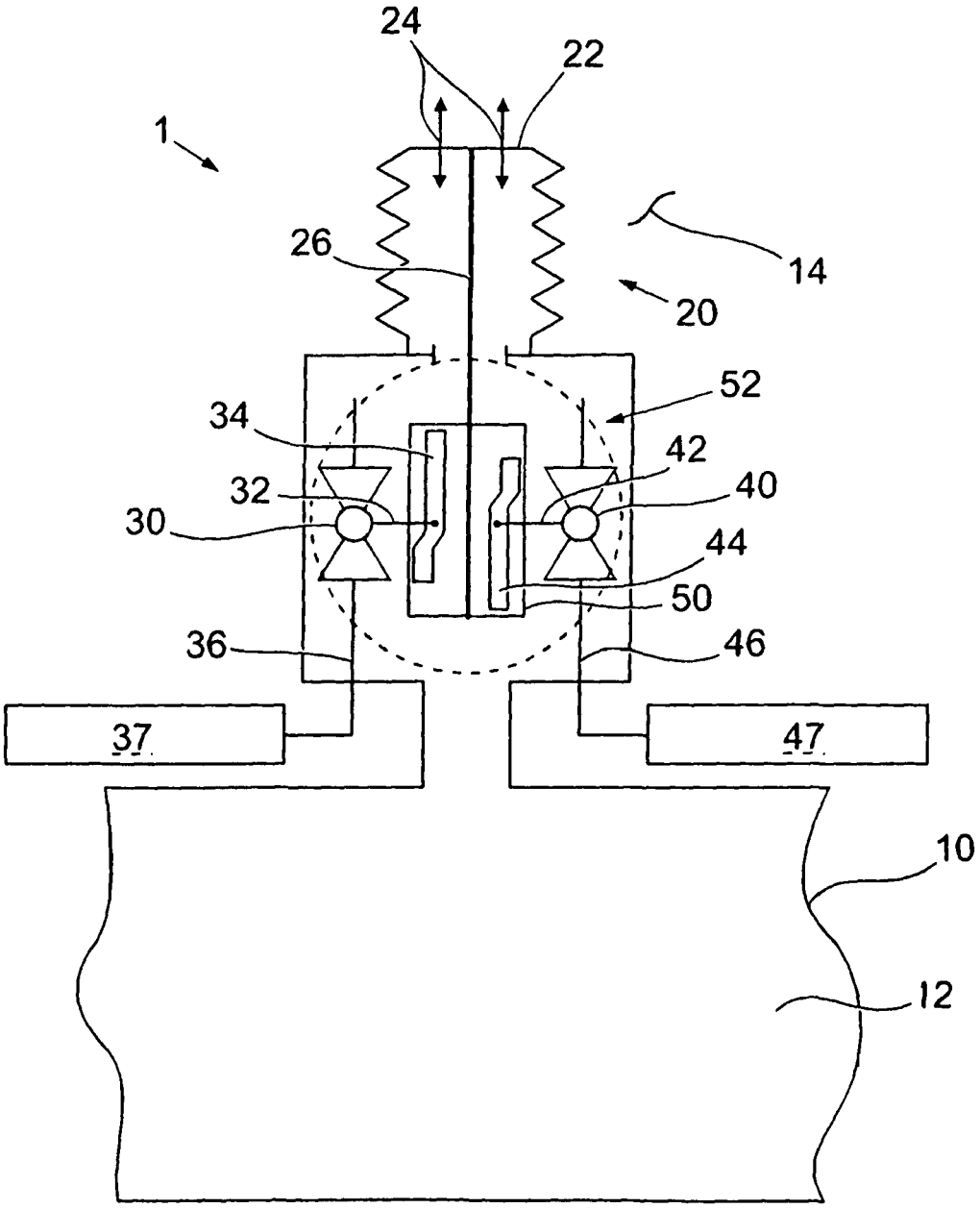
FIG. 1 is a schematic view of a compensator having a protection system according to one embodiment of the invention.

A compensator is shown generally at 1 in FIG. 1. The compensator 1 is in fluid communication with an apparatus that has a housing 10 containing a fluid 12. The housing 10 and compensator 1 substantially isolates the fluid 12 from the external environment. The compensator 1 is provided with a flexible bellows unit 20 that is extendable and retractable in the direction of arrows 24. The bellows unit 20 has a semi-rigid end plate 22 and is manufactured from metal according to the present embodiment.

The compensator 1 is provided with a protection system shown generally at 52. The protection system 52 comprises two valves: a vent valve 30 and an intake valve 40. Each valve 30, 40 is operable to open and close ports (not shown) that are in selective fluid communication with the interior of the housing 10. The port of the vent valve 30 is attached to an outlet 36 leading to a vent collection system 37 (not shown). The port of the intake valve 40 is attached to an inlet 46 coupled to a fluid supply 47 (not shown). The vent valve 30 and intake valve 40 are ¼ turn ball valves according to this preferred embodiment. ¼ turn ball valves are preferred because they are less prone to failure through trapped debris than other valve designs, but it will be appreciated that other types of valve are also suitable.

The valves 30, 40 each have respective cam followers 32, 42 that are moveable to open and close the valves 30, 40. Each cam follower 32, 42 engages a cam plate 50. The cam plate 50 has two kinked slots 34, 44 shaped to receive the respective cam followers 32, 42 which are constrained to movement within the respective slot 34, 44. The kinked slots 34, 44 each have first and second laterally spaced parallel portions, connected by a transverse portion. The cam followers 32, 42, interact with the slots 34, 44 of the cam plate 50 to actuate the vent valve 30 and the intake valve 40 respectively.

The end plate 22 of the bellows unit 20 is fixed to a rod 26. Another end of the rod 26 is attached to the cam plate 50. The cam plate 50 is therefore movable in concert with the bellows unit 20 relative to the valves 30, 40 that are immovably connected to the housing 10.

The compensator 1 is used to physically separate the fluid 12 contained within the housing 10 from a fluid 14 in the environment surrounding the housing 10, whilst substantially equalizing the pressure between the internal fluid 12 and the external fluid 14. The pressure equalisation is achieved by means of the flexible membrane in the form of the bellows unit 20. The compensator 1 is generally arranged to allow sufficient movement of the bellows unit 20 to provide pressure equalisation over a range of pressures changes, while accounting for gas compression effects. This pressure balancing ability of the compensator 1 is used to avoid high pressure differentials across the walls of the housing 10. As a result, the thickness of the housing 10 can be selected to withstand small pressure differentials between the interior of the housing 10 and the ambient environment and therefore allows the housing to have a reduced thickness compared with a housing that must retain large pressure differentials. Consequently the weight and associated cost of the housing can be reduced.

The sequence of operation of the compensator 1 and the protection system 52 will now be described with reference to FIGS. 2*a* to 2*e*. According to the present embodiment, the compensator 1 is intended for use in a remotely operated vehicle (ROV) that during normal use is subject to a range of pressures from surface to a depth of 3000 meters. The compensator 1 is adapted to remain in operation when subjected to variations in the fluid 12 volume and/or pressure resulting from changes in the ambient pressure of the external fluid 14. Maintenance of correct compensator 1 function is dependent on avoiding damage to the metal bellows unit 20 due to the application of excessive over- or under-pressure which can typically be caused by leaking fluid supply/vent valves, for example.

Figures 2A, 2B, 2C, 2D, 2E:
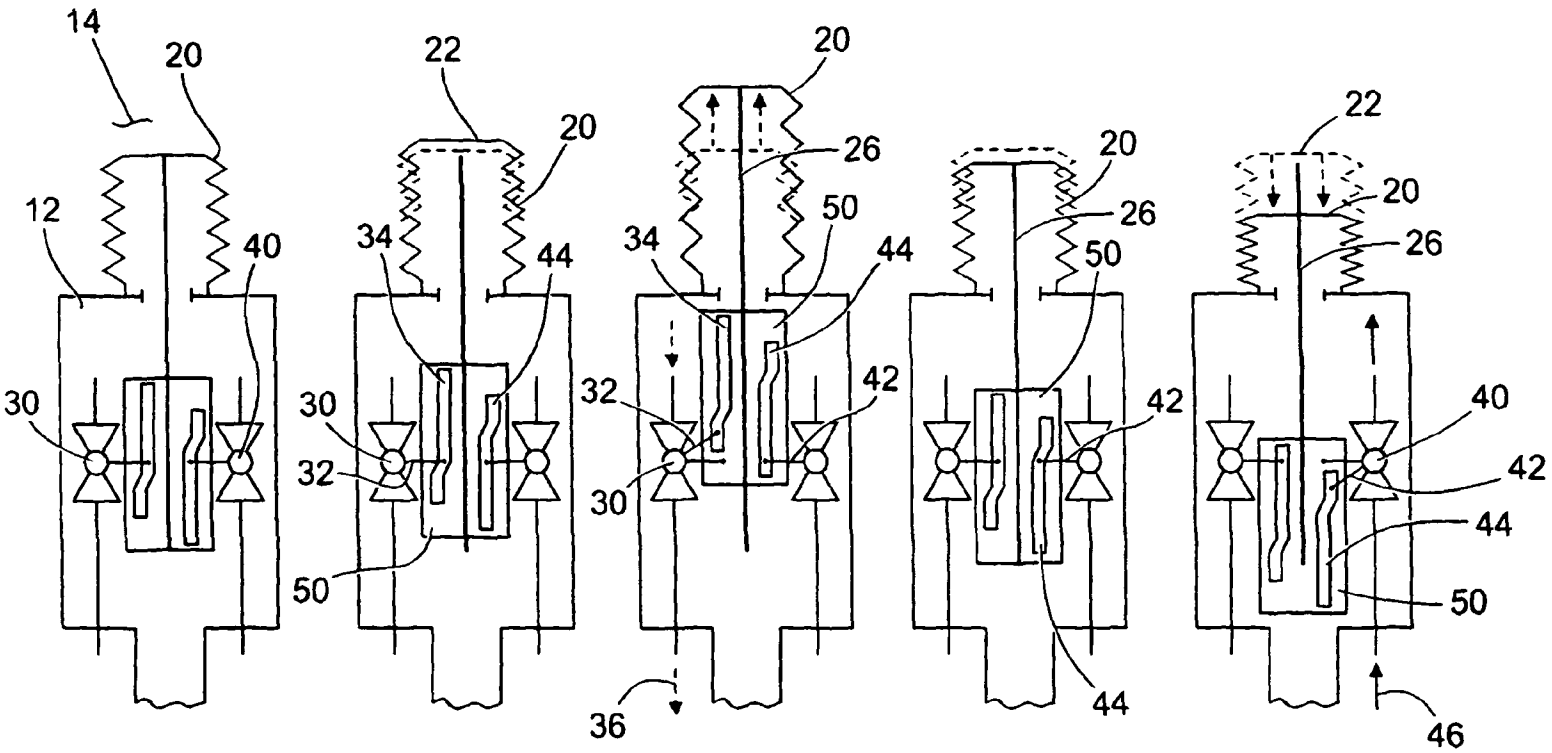
FIGS. 2*a* to 2*e* are schematic views of the sequence of operation of the compensator and protection system of FIG. 1.

In operation, the pressure of the fluid 12 acts on the interior of the bellows unit 20 and tends to extend it, whereas the pressure of the external fluid 14 tends to force the bellows unit 20 to retract. These opposing pressures act on a substantially similar area corresponding to the area of the bellows unit 20. If these pressures are equal, they would therefore create substantially equal and opposite forces, and the bellows unit 20 is in equilibrium and remains stationary (FIG. 2*a*).

During normal use of the compensator 1, the bellows unit 20 moves within a set of normal operating limits. These limits are predetermined to cater for normal operational conditions, such as for the ROV mounted equipment moving from surface to the operational depth and the reverse. Movement of the bellows unit 20 within the normal operational limits causes neither the actuation of the vent valve 30 nor the intake valve 40 (FIGS. 2*b* & 2*d*). The protection system 52 therefore only comes into operation in the event of bellows unit 20 movement outside these limits (FIGS. 2*c* & 2*e*).

In the event that the pressure/volume of the internal fluid 12 increases beyond that of the external fluid 14, there is the potential for over-expansion of the bellows unit 20. As the bellows unit 20 expands, it pulls the cam plate 50 attached via the rod 26 upwardly relative to the vent valves 30, 40 that are held stationary, so that the cam followers 32, 42 move along the longitudinal portions of the respective slots 34, 44 (FIG. 2*b*). When the cam follower 32 of the vent valve 30 reaches the transverse portion in the slot 34 on the cam plate 50, the cam follower 32 starts to turn the vent valve 30 to prevent over-expansion. As the bellows unit 20 continues to move upwards, the cam follower 32 quickly turns the vent valve 30 as the cam follower 32 travels through the transverse portion of the slot 34. By the time the cam follower 32 reaches the end of the transverse portion of the slot 34 and travels into the second longitudinal portion (FIG. 2*c*), the vent valve 30 has typically been fully opened by the cam plate 50 and the fluid is vented through the outlet 36 to the vent collection system 37.

Since operation of the vent valve 30 is automatic, it guards against over-pressurisation and failure or permanent distortion of the compensator bellows unit 20. This is particularly important for use in very deep water, where recovery or repair is extremely expensive.

The inlet valve 40 controls the inlet 46 in fluid communication with a supply system 47. Should the bellows unit 20 begin to retract, the rod 26 moves the cam plate 50 relative to the valves 30, 40 such that the cam follower 32 moves through the transverse portion of the slot 34 and then into the longitudinal portion of the slot 34 to close the vent valve 30. Continued retraction of the bellows unit 20 causes the cam follower 42 to move through the slot 44 towards the transverse portion (FIG. 2*d*). Should the external fluid 14 pressure continue to force the bellows unit to retract, for example, because of continuing loss of fluid 12, the cam follower 42 moves through the transverse portion of the slot 44 to open the inlet valve 40 (FIG. 2*e*) and increase the fluid 12 volume within the housing 10 to stabilise the system.

The cam plate 50 and kinked slot 34, 44 arrangement operates the valves 30, 40 in the correct sequence, as well as providing dwell periods, controlled by the lengths of the transverse portions of the slots 34, 44. This arrangement also provides direct and simple mechanical operation of the valves 30, 40 using the bellows unit 20, which generates a considerable force on the operating cam followers 32, 42. This ensures that the valves 30, 40 are operated in a positive, robust, and reliable manner.

The protection system 52 is therefore derived from linking the acceptable limits of bellows unit 20 movement to the valves 30, 40, which remain dormant during the normal operating conditions, but that are activated when the bellows unit 20 moves beyond the predetermined acceptable limits, to either vent the fluid 12 in the compensator 1 and housing 10 or provide the housing 10 with more fluid 12 to stabilise the volume within the compensator 1 and achieve a pressure equilibrium once again across the bellows unit 20.

The bellows unit 20 can be damaged by over- or under-expansion. Such damage may be in the form of a rupture that leads to leakage or a permanent distortion (more common for metal bellows) leading to its unpredictable and impaired performance. Thus, the invention provides a system and method that limits membrane movement to within acceptable operational limits. It restricts movement of the membrane beyond predetermined limits beyond which damage to the membrane could occur. In order to prevent this damage the compensator 1 is provided with the protection system 52 that is automatically actuated in such a situation. As previously described, if the bellows unit 20 extends or retracts beyond the predetermined operational limits, the vent valve 30 and the intake valve 40 are sequentially operated to prevent damage to the bellows unit 20.

Figure 4:
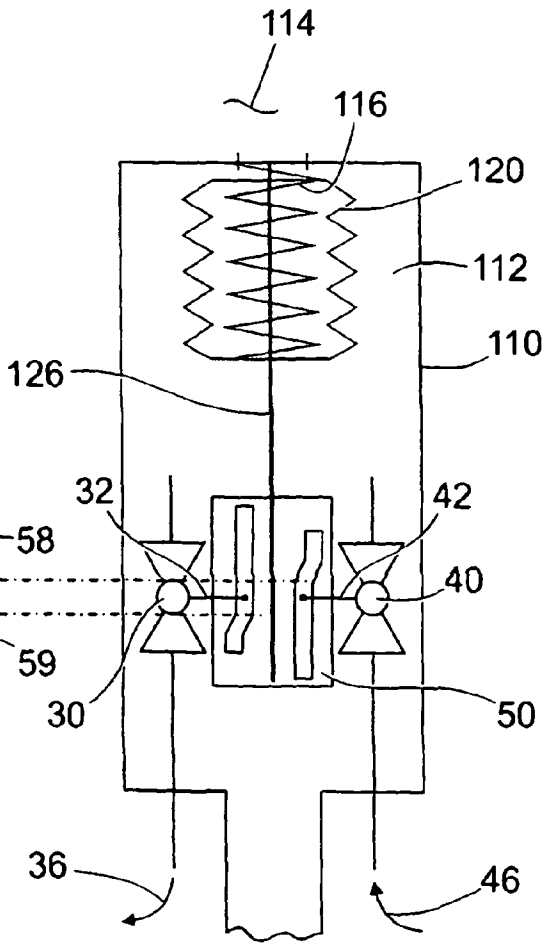
FIG. 4 is a schematic view of a different compensator with the protection system of FIG. 1.
Figure 3:
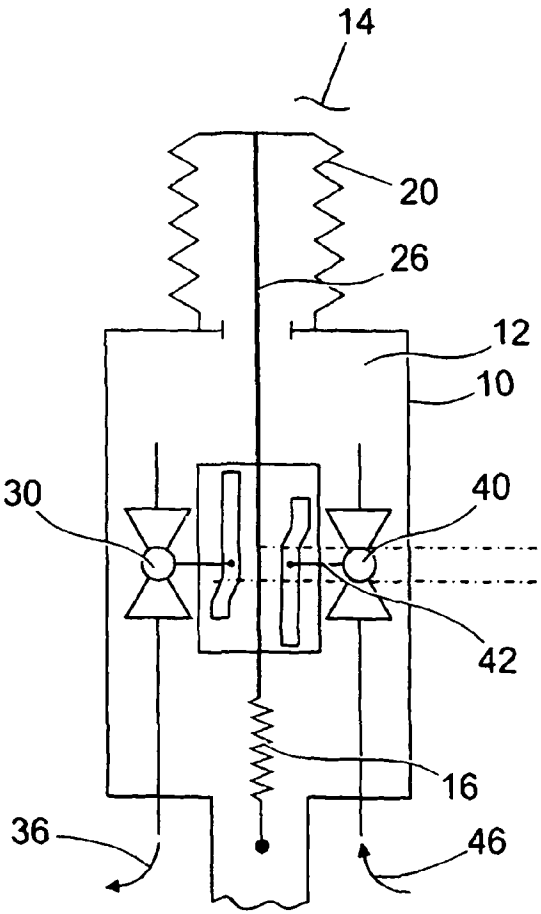
FIG. 3 is a schematic view of part of the compensator of FIG. 1.

Two alternative arrangements of the compensator are shown in FIGS. 3 and 4. Like reference numerals have been used to denote like components. The bellows unit 20 shown in FIG. 3 is placed under slight compression by a spring 16 attached to the cam plate 50 and the rod 26.

The load generated by the spring 16 adds to the force tending to cause a retraction of the bellows unit 20. Consequently, in order to achieve equilibrium, the pressure of the fluid 12 must generate a force equal to the pressure of the external fluid 14 in addition to the force exerted by the spring 16.

The spring 16 may be used to act on the compensator where appropriate. Where no spring 16 is used, the compensator then maintains an equilibrium pressure near or at the ambient pressure.

FIG. 4 shows a slightly different compensator arrangement. A bellows unit 120 extends within a housing 110. The function of the bellows unit 120 is the same as described with reference to the previous embodiment and transfers pressure between an external fluid 114 and an internal fluid 112, while keeping the two fluids physically separate. As for FIG. 3, a spring 118 acts on the bellows unit 120 such that the pressure of the internal fluid 112 must overcome the pressure of the external fluid 114 as well as the force of the spring 118 in order to cause movement of the bellows unit 120. The arrangement of FIG. 4 differs in the placement of the bellows unit 120, such that an over-filling of the internal chamber with fluid 112 causes a retraction of the unit 120 rather then an extension of the unit. Similarly, an excessive loss of the internal fluid 112 would cause an extension of the bellows unit 120 rather than a retraction. Due to the direction of extension of the bellows unit 120 a rod 126 linking the unit 120 with the cam plate 50 is slightly shorter. The remainder of the protection system is as previously described.

The spring 16, 116 biases the bellows units 20, 120 towards the internal fluid 12, 112 so that the internal fluid 12, 112 is at a slightly higher pressure relative to the external fluid 14, 114. The biasing force of the spring 16, 116 is therefore added to the external pressure resulting in a slight increase in the pressure of the internal fluid 12, 112 in order to maintain the bellows unit 20, 120 in equilibrium. This is advantageous because any leakage of fluid would occur from the internal fluid 12, 112 to the external fluid 14, 114. The force of the springs 16, 116 can be varied to achieve the required minimum internal fluid 12, 112 pressure.

In each of the embodiments shown in FIGS. 1 to 4, the movement of the valves 30, 40 is controlled by the cam plate 50, which is arranged to positively drive the valves 30, 40 open and shut according to movement of the bellows unit 20, 120. The kinked slots 34, 44 in the cam plate 50 can be arranged to allow dwell periods and over-run of the bellows unit 20, 120. Dwell periods allow one valve to remain in one state (open or shut) whilst the other valve remains as it is or is changing state. Over-run allows for a reaction time between the change in the state of a valve 30, 40 and the bellows unit 20, 120 to respond accordingly.

Figure 5:
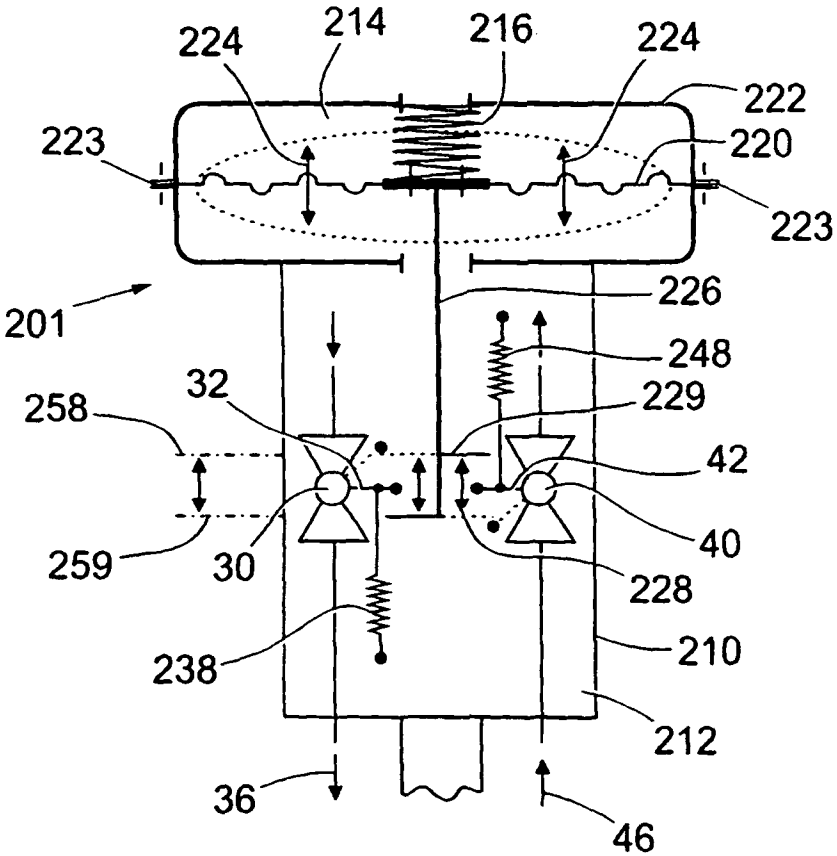
FIG. 5 is a schematic view of a different compensator and a valve arrangement according to another embodiment of the invention.

FIG. 5 shows an alternative compensator 201 with a slightly modified protection system. Like components of the compensator have been given like reference numerals with the prefix "2". The compensator 201 comprises an enclosure 222 that is formed from two half shells joined along an edge 223. A flexible membrane 220 is sealed between the half shells within the enclosure 222 to separate one half of the enclosure 222 that is in fluid communication with a housing 210 from another half of the enclosure that is exposed to an external fluid 214. The membrane 220 is movable in a direction shown by arrows 224 in response to a pressure differential between an internal fluid 212 and the external fluid 214. A bias is applied to the membrane 220 by a spring 216. Again, the spring 216 functions to maintain the pressure of the internal fluid 212 at a slightly higher pressure relative to the pressure of the external fluid 214.

Where identical components of the protection system have been described previously, the same reference numerals have been used. A T-shaped rod 226 is attached to the membrane 220. The rod 226 has two laterally offset opposing arms: one arm 227 is movable in the same plane as the cam follower 32 and the other arm 229 is moveable in the same plane as the cam follower 42. The arms 227, 229 are moveable in a direction shown by arrows 228. There is some lateral overlap between an outermost end of the cam follower 32 and an outermost end of the arm 227, such that the arm 227 is arranged to contact the cam follower 32 in a position (shown by dashed line 258) corresponding to the predetermined maximum desired extension limit of the membrane 220. Similarly, there is some lateral overlap between an outermost end of the cam follower 42 and an outermost end of the arm 229, such that the arm 229 is arranged to contact the cam follower 42 in a position (shown by dashed line 259) corresponding to the predetermined maximum desired retraction of the membrane 220.

The cam follower 32, 42 are coupled to springs 238, 248 respectively. The springs 238, 248 are used to bias the valves 30, 40 into their closed positions. Such an arrangement ensures that as a default, the valves 30, 40 remain in their inoperative state, but can be positively opened (by movement of the arms 227, 229 attached to the rod 226 when the rod 226 is drawn beyond the acceptable predetermined limits of the membrane 220.

Figure 6:
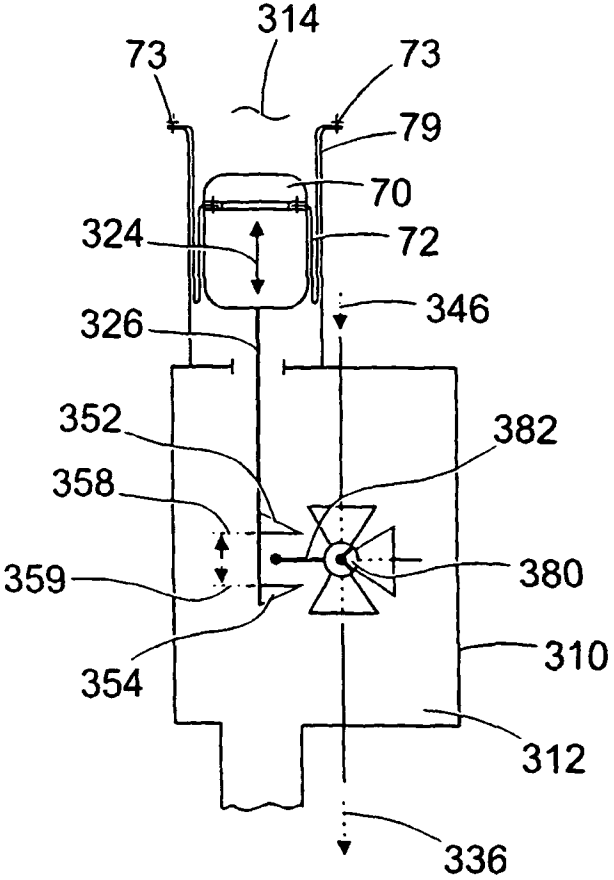
FIG. 6 is a schematic view of an alternative compensator and a protection system according to a further aspect of the invention.

An alternative compensator 301 and protection system is shown in FIG. 6. Like components of the compensator have been given like reference numerals with the prefix "3". The housing 310 of the compensator 301 is attached along an edge 73 to a flexible membrane 72 that can be turned inside out in the form of a rolling diaphragm attached to a piston 70. Generally the membrane 72 is a thin, flexible cylinder that is attached at one end to a guide tube 79, and at another end to the piston 70 running inside the guide tube 79. Friction effects of the piston 70 are minimised and pressure can be transmitted without significant attenuation due to the rolling thin flexible membrane 72. The piston 70 is moveable in a direction shown by arrow 324 and is driven by the relative pressure difference between the internal fluid 312 and the external fluid 314. The rod 326 attaches to the piston 70 and has two axially spaced arms: an upper arm 352 and a lower arm 354.

The protection system of FIG. 6 incorporates a three-way ¼ ball valve 380. The three-way ball valve functions both as an inlet 346 from a supply and an outlet 336 leading to a vent collection reservoir. The valve 380 also has a lever arm 382 that extends and is movable in the same plane as the arms 352, 354 of the rod 326. There is some overlap between an outermost end of the lever arm 382 and an outermost end of the arms 352, 354 such that the arms 352, 354 are arranged to contact the lever arm 382.

Figure 7C:
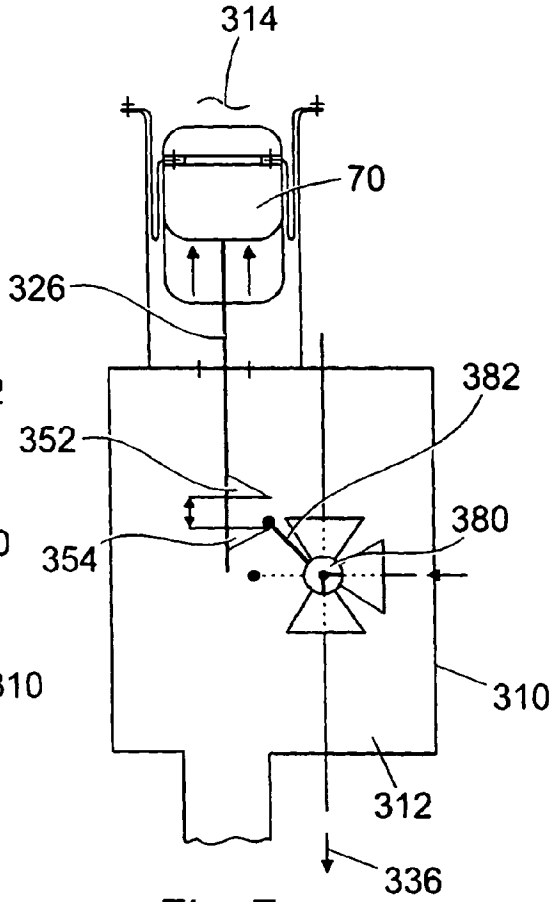
FIGS. 7*a* to 7*c* are schematic views of the sequence of a venting operation of the compensator and protection system of FIG. 6.
Figure 7B:
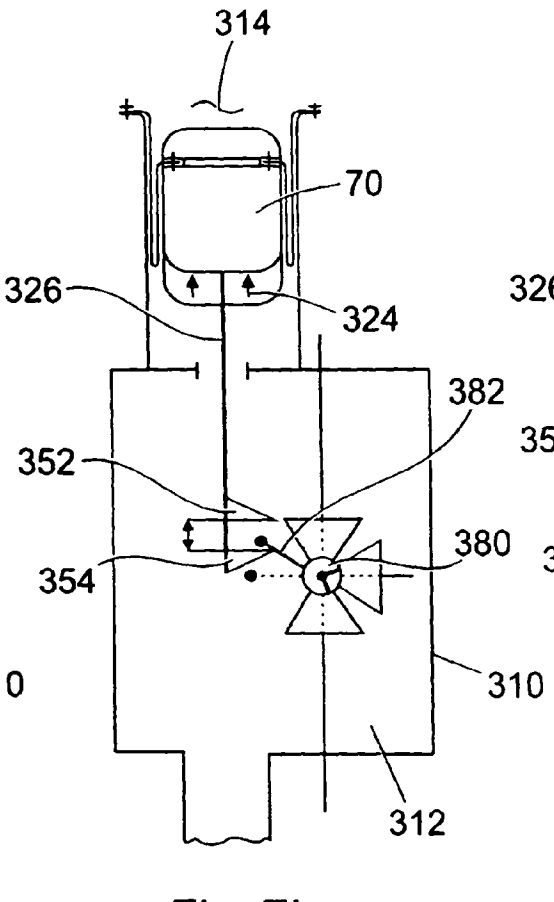
Figure 7A:
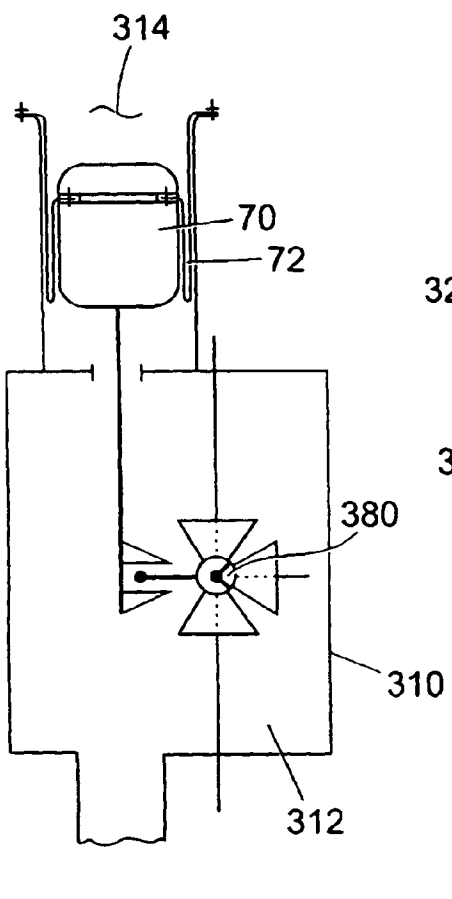

The sequence of operation of the protection system of FIG. 6 will now be described with reference to FIGS. 7*a* to 7*c*. During normal use, when the membrane 72 is in equilibrium due to the balancing of pressures between the internal fluid 312 and the external fluid 314, the valve 380 is dormant (FIG. 7*a*).

In the event that the pressure/volume of the internal fluid 312 increases beyond that of the external fluid 314, there is the potential for over-extension of the membrane 72. As the membrane 72 extends, it pulls the attached rod 326 upwardly relative to the valve 380 that is held stationary. When the arm 354 contacts the lever arm 382, the arm 354 starts to turn the valve 380 to prevent over-extension of the membrane 72 (FIG. 7*b*). As the membrane 72 continues to move upwards, the lever arm 382 turns the valve 380 into the vent position (FIG. 7*c*). The valve 380 will remain in the vent position until it is positively closed by the action of the rod 326 coupled to the piston 70 to drive the arm 352 into contact with the lever arm 382 when the external pressure 314 acting on the membrane 72 once again exceeds the pressure of the internal fluid 312.

Figure 8C:
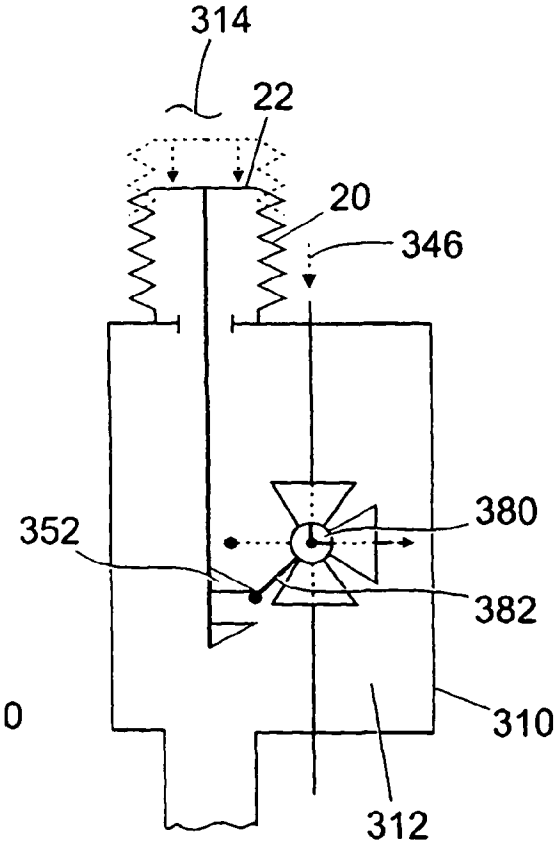
FIGS. 8*a* to 8*c* are schematic views of the sequence of an intake operation of the compensator of FIG. 1 combined with the protection system of FIG. 6.

The mechanism by which the valve 380 is moved to an intake position is described with reference to FIGS. 8*a* to 8*c* that show the protection system with the three-way ¼ turn ball valve 380 of FIG. 6 operational with the bellows unit 20 previously described with reference to FIG. 1.

Figure 8B:
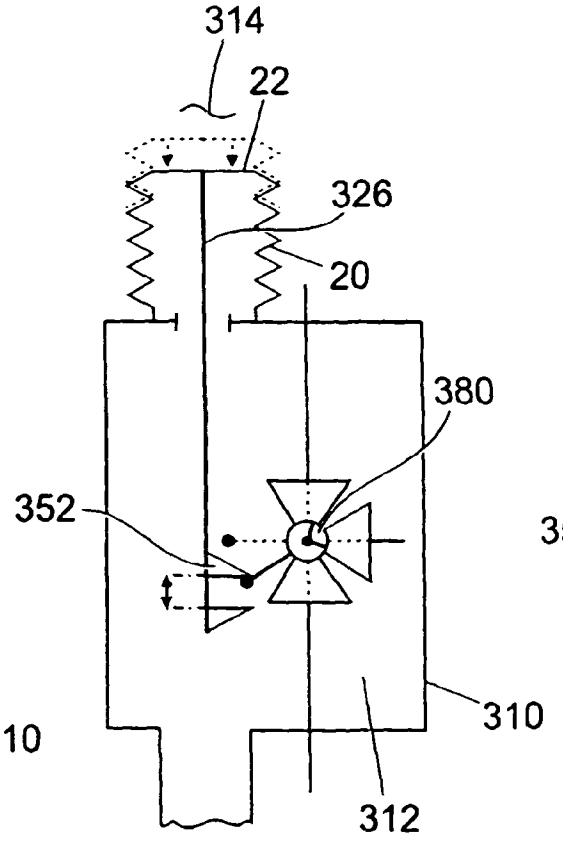
Figure 8A:
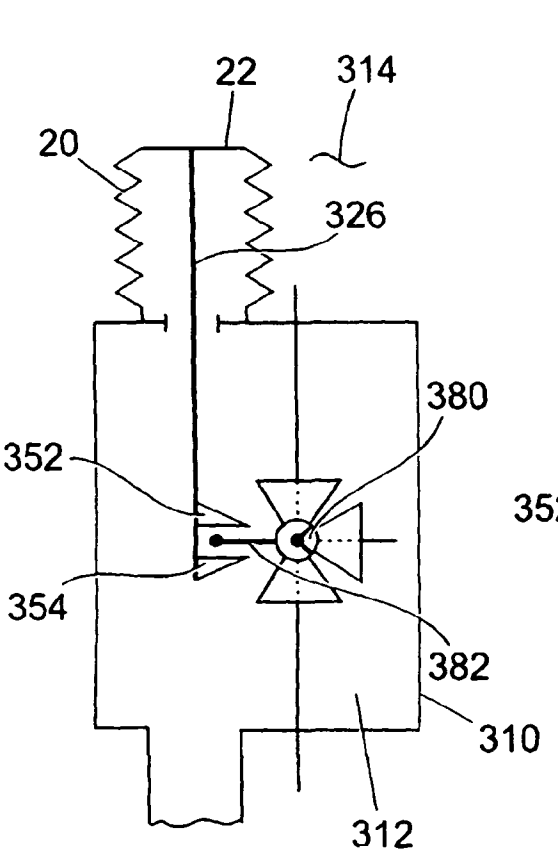

Should the bellows unit 20 begin to retract, the rod 326 moves the arm 352 relative to the valve 380 such that the lever arm 382 contacts the arm 352 (FIG. 8*b*). If the external fluid 314 pressure continues to force the bellows unit 20 to retract, the arm 352 forces the valve 380 into the intake position to thereby increase the fluid 312 volume and pressure within the housing 310 to stabilise the system (FIG. 8*c*).

The embodiments of FIGS. 6 through to 8*c* show how the arms 352, 254 are moveable to change the state of the three-way ball valve 380. According to this arrangement, the valve 380 must be positively driven into its vent and intake positions so that it can change state. The distance between the arms 352, 354 determines the degree of extension/retraction of the membrane 72, 20 between movement of the valve 380 between vent and intake positions.

Figures 9A, 9B, 9C, 10A, 10B, 10C:
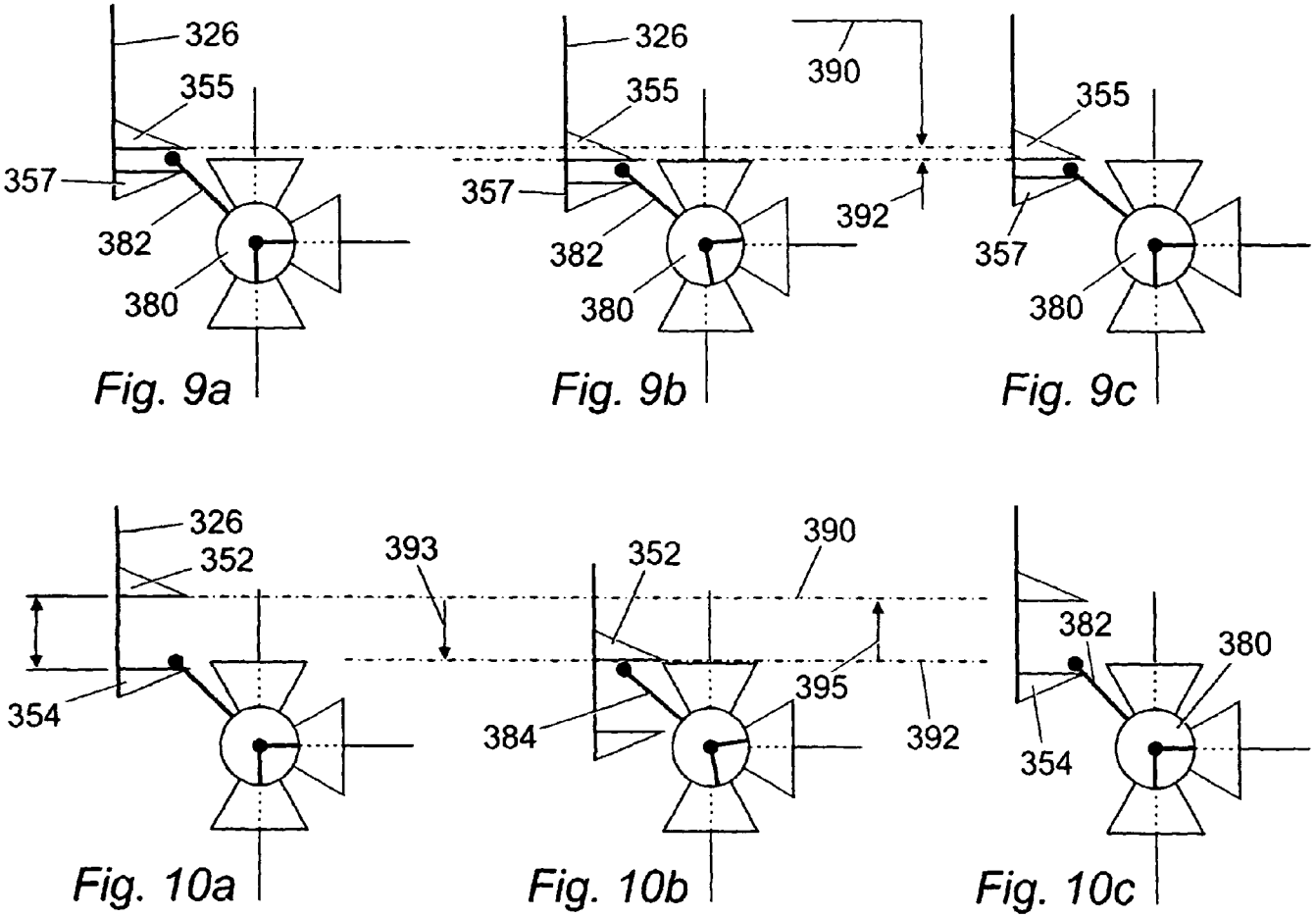
FIGS. 9*a* to 9*c* are schematic views of a modified valve arrangement of the protection system shown in FIG. 6.
FIGS. 10*a* to 10*c* are schematic views of the valve arrangement of the protection system shown in FIG. 6.

FIGS. 9*a* to 9*c* show two arms: an upper arm 355 and a lower arm 357 that are positioned close to one another on the rod 326. The spacing between these arms 355, 357 corresponds to the distance between the dashed lines indicated by the arrows 390, 392. FIG. 9*a* shows the valve in a vent position. Slight retraction of the piston 70 or the bellows unit 20 due to venting of internal fluid 312 and a consequent drop in pressure of the internal fluid 312 will cause the rod 326 to move downwardly such that the upper arm 355 immediately contacts the lever arm 382 and begins to move the valve 380 away from the vent position. This movement away from the vent position shuts the valve 380. However, if the fault remains (i.e. the fault that caused the initial over-extension) then this can result in a re-extension of the piston 70 or bellows unit 20. This leads to immediate contact of the lower arm 357 with the lever arm 382 thus re-opening the valve 380 (FIG. 9*c*). Consequently, if the arms 355, 357 are positioned too close to one another the valve 380 may "dither" between the two states of open and shut.

In order to avoid this the spacing between the arms 352, 354 should be selected according to the application. The spacing of the arms 352, 354 of FIGS. 6 through to 8*c* and 10*a* to 10*c* ensure that the dither position is avoided and that the system has sufficient time to change the state of the valve and then allow the system to stabilise before further action.

Figure 11:
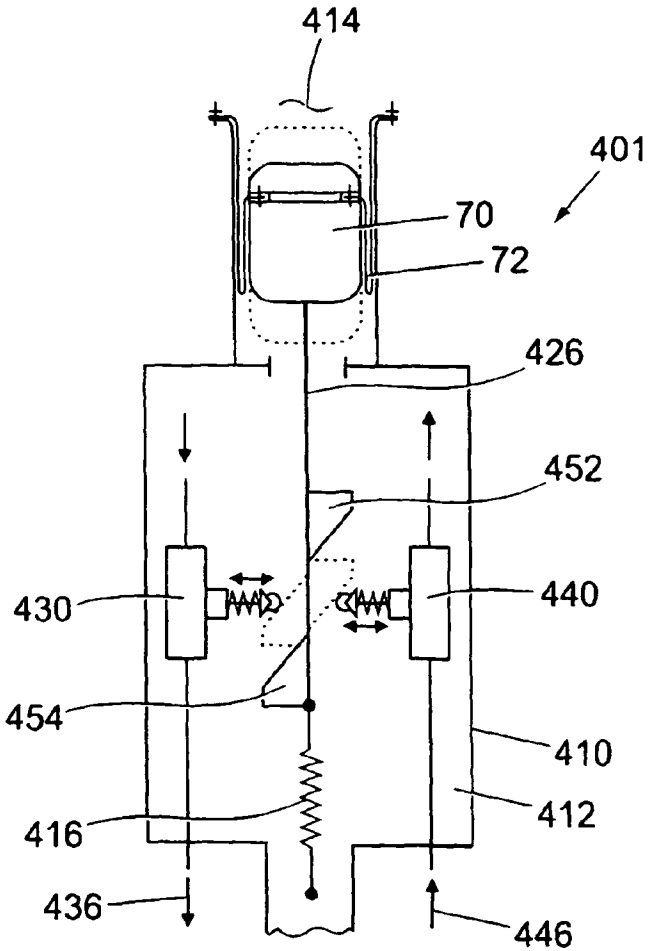
FIG. 11 is a schematic view of the compensator of FIG. 6 with a protection system according to another embodiment of the invention.

An alternative compensator 401 and protection system is shown in FIG. 11. Like components of the compensator have been given like reference numerals with the prefix "4". The compensator uses a rolling diaphragm similar to that previously described. The piston 70 and the rod 426 attached thereto are biased by the spring 416 towards the interior of the housing 410.

The valves 430, 440 are spring return poppet valves. These valves 430, 440 are biased into their dormant state and are opened by laterally offset opposing cams 454, 452 respectively to vent and intake fluid when actuated by the rod 426 that is directly linked to movement of the rolling diaphragm.

Figure 12:
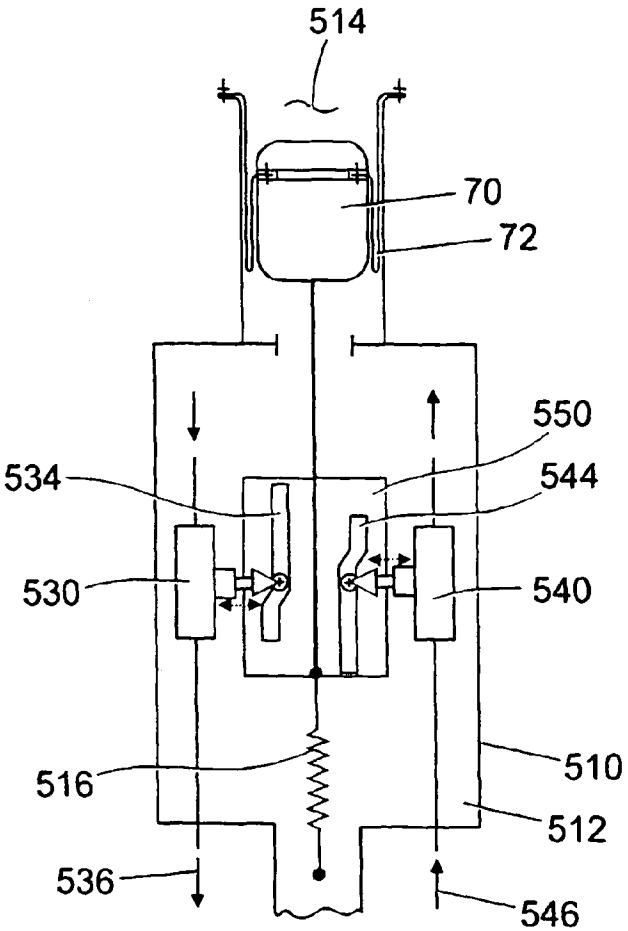
FIG. 12 is a schematic view of the compensator of FIG. 6 with a protection system according to another embodiment of the invention.

A slightly different embodiment is shown in FIG. 12. Like components of the compensator have been given like reference numerals with the prefix "5". The rod 526 is attached to the cam plate 550, both of which are biased by the spring 516 towards the interior of the housing 510. Push rod ends of the poppet valves 530, 540 are constrained within respective slots 534, 544 on the cam plate 550 to positively open and shut the poppet valves 530, 540 by movement of the valves 530, 540 in the directions of arrows 555. This movement is directly linked to movement of the rolling diaphragm arrangement through the cam plate 550 and slot 534, 544 arrangement.

According to another embodiment not shown in the Figures, a motion transducer detects the position of the bellows unit, rolling diaphragm or membrane as it extends and retracts. The motion transducer can operate a solenoid valve that changes state to intake fluid when a predetermined lower level is reached, and vent fluid when a predetermined upper level is reached.

Figure 13:
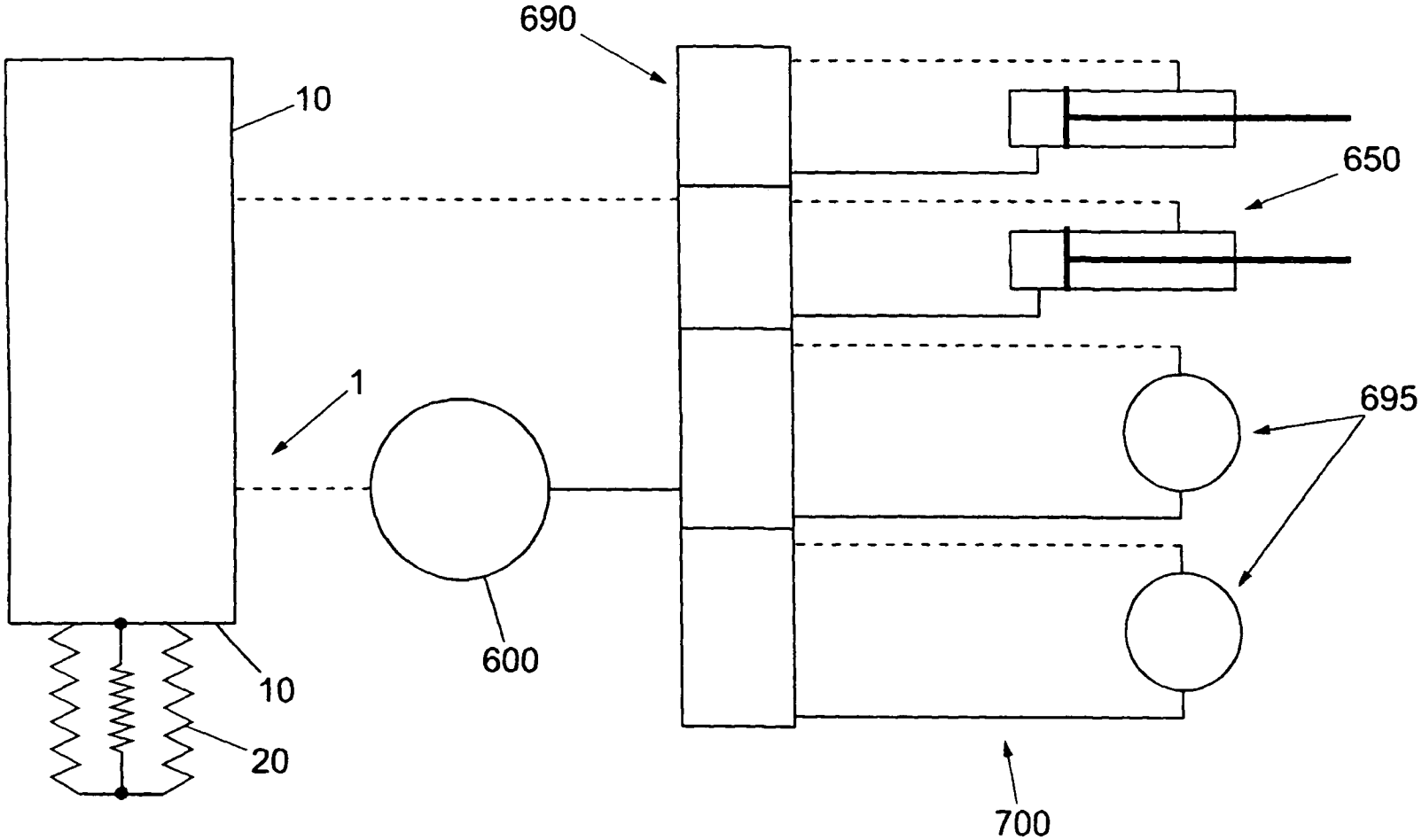
FIG. 13 is a schematic view of a modified compensator of FIG. 1 and a hydraulic power/control system coupled to the compensator.

FIG. 13 shows a hydraulic system 700 that incorporates the compensator 1. Return lines that are shown as dashed lines and supply lines that are shown as continuous lines. If the hydraulic system 700 is used at different depths below the surface of the sea, then the interior of the housing 10 is maintained at a pressure slightly higher than that of the ambient sea pressure by means of a spring 116. The fluid within the housing 10 provides a compensated hydraulic fluid supply for a pump 600. The outlet of the pump 600 is directed through control valves 690 that distribute the fluid as necessary to cylinders 650 and motors 695. Therefore, the supply of fluid to the cylinders 650 and motors 695 is always maintained at or close to the pressure of the sea.

As a result of the compensator 1 function, the components of the hydraulic system 700 are operable with the same pressure differentials regardless of the pressure of the ambient environment i.e. the depth of the apparatus when used subsea. This equalisation of the pressure of the hydraulic components with the external environment allows the components to be sized as they would for surface use and arranged to generate the pressure required of the specific component, rather than having to generate the pressure required of the component in addition to the pressure needed to overcome the ambient pressure. For example, if the hydraulic system 700 is at a depth of 1000 meters, the ambient pressure will be 100 bar. If the cylinders 650 requires a working pressure of 50 bar, the compensated pump 600 need only generate a pressure of 50 bar, rather than 150 bar, which would be required if the system 700 was not compensated. Any of the compensators previously described have the advantage that they can be used with the hydraulic system 700.

Any of the above embodiments can be coupled to a reserve fluid supply to cater for leakage. Typically, the reserve fluid supply will be geared to account for a relatively slow and short term fluid loss. However, in some cases there may be a need to maintain an equalised pressure in the presence of a deliberate, small and continuous loss of internal fluid. For example, this might be required in order to provide a controlled low level leakage across a mechanical seal for lubrication purposes. In this case, there will be a make-up supply sized to accommodate the loss and the membrane will typically oscillate between maximum and minimum positions.

The drive pressure for the flow of lubricant will typically be provided by a suitable spring load on the membrane as previously described.

According to another embodiment of the invention not shown in the Figures, fluid discharged from subsea equipment can be collected in a compartment that has a variable volume. For example, fluid discharged from the return side of a double acting cylinder can be collected in a flexible compensated collection tank that is exposed to ambient sea pressure. The compensated collection tank functions to prevent the discharge of contaminants, for example hydrocarbons, into the environment. The tank expands to match the volume of discharged fluids at the ambient pressure, so that the fluids remain separated without generating a back pressure. This avoids the need for collection of oil in hard tanks, which require complicated venting arrangements. The flexible tank is protected by the present invention against damage through over-extension, with the consequent potential for damage and loss of fluid into the environment. This protection system only requires the use of a vent valve to discharge internal fluid. Thus, detection means are only required to detect overextension of the flexible tank and interact with the actuator to actuate the vent valve when required. The detection means can include sensors, alarms, ROV observation and the like.

The present invention can utilise any type of valve suitable for the purpose, such as a ball valve, poppet valve solenoid actuated or spring return valve. However, ball valves are less vulnerable to the effects of entrained dirt. Additionally, any leakage arising from a ball valve is generally confined to seepage since the valve seals are in constant contact with the ball, the rotation of which has a self-cleaning action. Thus the ball valve is generally preferable to valves such as the solenoid actuated/spring return type where the seal and seating are physically separated in the open position and consequently the valve can be held open by dirt trapped between them, thus making them more vulnerable to leakage.

The valves may also be combined with membrane position alarms and/or compensator pressure alert alarms to alert operators to potential failures so that the necessary remedial action can be taken.

Modifications and improvements can be made without departing from the scope of the invention. Different aspects of every described embodiment can be used in combination with aspects of other embodiments where appropriate.

The invention claimed is:

1. A compensator adapted to maintain liquid within a housing of subsea equipment close to a variable ambient pressure, the compensator comprising:

a fluid compartment arranged to contain liquid wherein at least one of the walls defining the compartment is a movable member, which movable member moves in use to alter the volume of the compartment;

and a protection system for the compensator, the protection system comprising:

a detection mechanism for detecting when the volume of the fluid compartment is outside a predetermined acceptable limit;

a valve arrangement mountable on at least one port that is in selective fluid communication with the fluid compartment; and an actuator, wherein the detection mechanism is coupled to the valve arrangement via the actuator, such that when the detection mechanism detects that the volume of the fluid compartment is outside the predetermined limit, the actuator causes the valve arrangement to change state and to alter the volume of the fluid compartment;

wherein the actuator is configured such that the valve arrangement remains in one state for a predetermined period of time during volume changes in the compartment caused by movement of the movable member, prior to a further change in state of the valve arrangement.

2. The compensator according to claim 1, wherein the valve arrangement is controllable by the actuator to maintain the volume of the fluid compartment between two predetermined limits.

3. The compensator according to claim 1, wherein the valve arrangement of the protection system comprises a vent valve, which is actuable to vent liquid from the fluid compartment, and an inlet valve to introduce liquid into the fluid compartment.

4. The compensator according to claim 1, wherein the valve arrangement comprises at least one quarter turn ball valve.

5. The compensator according to claim 1, wherein the valve arrangement comprises one valve mountable on the port and wherein the valve can be configured to act as both a vent valve and an inlet valve.

6. The compensator according to claim 5, wherein the inlet valve and the vent valve are sequentially actuable.

7. The compensator according to claim 5, wherein the valve is a three-way ball valve.

8. The compensator according to claim 1, wherein the valve arrangement comprises two valves that are controllable to maintain the volume of the fluid compartment between two predetermined limits, and wherein one of the valves is arranged to maintain the volume of the fluid compartment within an upper limit and the other valve is actuable to maintain the volume of the fluid compartment above a lower limit.

9. The compensator according to claim 1, wherein the actuator is arranged to cooperate with the valve arrangement to positively change the state of the valve arrangement in each direction.

10. The compensator according to claim 1, wherein the actuator is arranged to cooperate with the valve arrangement to positively change the state of the valve arrangement in one direction and wherein the valve arrangement is biased into a return position in the other direction.

11. The compensator according to claim 1, wherein the detection mechanism comprises a mechanical linkage to the movable part of the fluid compartment, wherein the mechanical linkage translates movement of the movable part to the actuator and wherein the actuator comprises protrusions that cooperate with the valve arrangement to change the valve arrangement.

12. The compensator according to claim 1, wherein the actuator comprises a cam plate that is cooperable with the valve arrangement and where the valve arrangement comprises at least one valve, wherein the cam plate has a slot for receiving an arm of at least one valve that is constrained to move in the slot and wherein the slot is shaped to turn the arm and thus change the state of the valve when the arm reaches the appropriate part of the slot on the cam plate.

13. The compensator according to claim 1, comprising at least one of a position alarm and a compensator pressure alarm.

14. The compensator as claimed in claim 1, for attachment to a housing comprising subsea equipment.

15. An apparatus comprising a compensator as claimed in claim 1 and a housing comprising subsea equipment in an interior thereof, the interior of the housing and the compensator being in fluid communication with each other.

16. A hydraulic device including the compensator according to claim 1.

17. A method of protecting a fluid compartment of variable volume in a compensator adapted to maintain liquid within a housing of subsea equipment close to a variable ambient pressure, wherein at least one of the walls defining the fluid compartment is a movable member, which movable member moves in use to alter the volume of the compartment, the method of protection comprising the steps of:

mounting a valve arrangement on at least one port that is in selective fluid communication with the fluid compartment;

coupling the valve arrangement to a detection mechanism via an actuator;

detecting when the volume of the fluid compartment is outside a predetermined acceptable limit; and actuating the valve arrangement to change state and alter the volume of the fluid compartment when the detection mechanism detects that the volume of the fluid compartment is outside the predetermined limit, wherein the valve arrangement remains in one state for a predetermined period of time during volume changes in the compartment caused by movement of the movable member, prior to a further change in state of the valve arrangement.

18. The method according to claim 17, including automatically maintaining the volume of the fluid compartment between an upper and a lower predetermined acceptable limit by selectively actuating the valve arrangement.

19. The method according to claim 17, including transferring pressure between the interior and exterior of the fluid compartment and thereby causing the volume of the fluid compartment to alter in response to a pressure differential.

20. The method according to claim 17, including actuating the valve arrangement to change the state thereof and actuating the valve arrangement to return the valve arrangement to its original state.

21. The method according to claim 17, including actuating the valve arrangement to change the state thereof and biasing the valve arrangement to return the valve arrangement to its original state.

22. The method according to claim 17, including mechanically coupling the detection mechanism to the actuator.

* * * * *